US012036591B2

(12) United States Patent
Arvedi et al.

(10) Patent No.: US 12,036,591 B2
(45) Date of Patent: Jul. 16, 2024

(54) PLANT AND PROCESS FOR THE CONTINUOUS PRODUCTION OF HOT-ROLLED ULTRA-THIN STEEL STRIPS

(71) Applicant: ARVEDI STEEL ENGINEERING S.P.A., Cremona (IT)

(72) Inventors: Giovanni Arvedi, Cremona (IT); Andrea Teodoro Bianchi, Piadena (IT); Aldo Mantova, Colico (IT); Roberto Venturini, Ospedaletto Lodigiano (IT)

(73) Assignee: ARVEDI STEEL ENGINEERING S.P.A., Cremona (IT)

( * ) Notice: Subject to any disclaimer, the term of this patent is extended or adjusted under 35 U.S.C. 154(b) by 193 days.

(21) Appl. No.: 17/759,667

(22) PCT Filed: Jul. 2, 2021

(86) PCT No.: PCT/IB2021/055952

§ 371 (c)(1),
(2) Date: Jul. 28, 2022

(87) PCT Pub. No.: WO2022/003641

PCT Pub. Date: Jan. 6, 2022

(65) Prior Publication Data

US 2023/0082080 A1 Mar. 16, 2023

(30) Foreign Application Priority Data

Jul. 3, 2020 (IT) ..... 102020000016120

(51) Int. Cl.
*B21B 1/46* (2006.01)
*B21B 45/00* (2006.01)

(52) U.S. Cl.
CPC ..... *B21B 1/46* (2013.01); *B21B 45/004* (2013.01)

(58) Field of Classification Search
CPC ..... B21B 45/04; B21B 45/004; B21B 1/46; B21B 1/463; B21B 2001/225; B21B 1/24; B21B 1/26
See application file for complete search history.

(56) References Cited

U.S. PATENT DOCUMENTS 8,479,550 B2 * 7/2013 Eckerstorfer ..... B21B 13/22 72/200
9,108,234 B2 * 8/2015 Eckerstorfer ..... C21D 9/60
(Continued)

FOREIGN PATENT DOCUMENTS

DE 19936010 A1 2/2001
DE 102008003222 A1 * 3/2009 ..... B21B 1/46
(Continued)

OTHER PUBLICATIONS

Translation of DE-102008003222 (Year: 2009).*
(Continued)

*Primary Examiner* — Bobby Yeonjin Kim
(74) *Attorney, Agent, or Firm* — Lucas & Mercanti, LLP

(57) ABSTRACT

A plant and process for the continuous production of hot-rolled steel strips with a minimum thickness of 0.3 mm is disclosed which includes a continuous casting device of thin or medium slabs with a thickness between 40 and 150 mm and a maximum width of at least 2100 mm followed by a roughing mill, a first induction furnace, a water descaler, a second induction furnace, a finishing mill, a cooling station, a cutting station and a winding station. A system for feeding a protective atmosphere containing ≤3% vol. oxygen is provided from the inlet of the second induction furnace to at least the third stand of the finishing mill. Between the continuous casting device and the roughing mill, an initial thermal conditioning and descaling section is provided hav-
(Continued)

ing in sequence an induction edge heater, an induction heater for the rest of the slab surface and a water descaler.

39 Claims, 14 Drawing Sheets

(56) References Cited

U.S. PATENT DOCUMENTS

| | | | | |
|---|---|---|---|---|
| 2009/0288798 | A1* | 11/2009 | Ondrovic | B21B 45/0218 164/415 |
| 2012/0043049 | A1* | 2/2012 | Klinkenberg | B22D 11/14 164/474 |

FOREIGN PATENT DOCUMENTS

| | | | | |
|---|---|---|---|---|
| EP | 0946316 | B1 | 1/2002 | |
| EP | 1011896 | B1 | 1/2002 | |
| EP | 1558408 | B1 | 8/2006 | |
| EP | 1868748 | B1 | 10/2008 | |
| EP | 1909979 | B1 | 10/2010 | |
| EP | 3154726 | B1 | 8/2018 | |
| JP | S63104724 | A | 5/1988 | |
| JP | H0466203 | A | 3/1992 | |
| WO | 2018189652 | A1 | 10/2018 | |
| WO | WO-2018189652 | A1 * | 10/2018 | B21B 1/46 |

OTHER PUBLICATIONS

International Search Report and Written Opinion for Corresponding International Application No. PCT/IB2021/055952, 14 pages, Nov. 4, 2021.

* cited by examiner

PLANT AND PROCESS FOR THE CONTINUOUS PRODUCTION OF HOT-ROLLED ULTRA-THIN STEEL STRIPS

CROSS-REFERENCE TO RELATED APPLICATIONS

This application is a 371 of PCT/IB2021/055952, filed Jul. 2, 2021, which claims the benefit of Italian Patent Application No.102020000016120, filed Jul. 3, 2020.

FIELD OF THE INVENTION

The present invention relates to a plant and a process for the continuous production of hot-rolled ultra-thin steel strips down to a thickness of 0.3 mm and with a limited amount of scale, so as to make them suitable to be directly coated against corrosion without undergoing specific preliminary surface conditioning treatments.

BACKGROUND OF THE INVENTION

It is well known that in the steel industry, in view of both the increases in the costs of raw materials and energy used and the increased competitiveness required by the global market, as well as increasingly restrictive regulations in terms of pollution, there is a particular need for a method of manufacturing high-quality hot-rolled steel strips which requires lower investment and production costs, resulting in ever thinner strip thicknesses. As a result, also the final product processing industry can become more competitive with lower energy consumption, so that the negative impact on the environment is also minimised.

The state of the art is essentially as described in previous patents by the same inventor such as EP 1558408, EP 1868748 and EP 1909979 to which reference is made for further details. In practice, the so-called ESP (Endless Strip Production) technology is used, which is based on "cast rolling" that combines the continuous casting of a thin slab with liquid core reduction (LCR=Liquid Core Reduction) with a first roughing phase through a roughing mill (HRM=High Reduction Mill) that produces an intermediate product, the so-called "transfer bar". Casting is carried out from an ingot mould system based on patents EP 0946316, EP 1011896 and EP 3154726, also by the same inventor, to which reference is made for further details, which concern the geometric profile of both the horizontal and vertical sections of the ingot mould, as well as the particular geometry of the nozzle designed for a high mass flow of material up to 7-8 tons/min.

The above-mentioned patent EP 1558408 also envisages the possibility of extracting rough sheets after the first roughing phase as an emergency system in case of problems in the portion of the plant downstream of the roughing mill, in order to avoid the interruption of the continuous casting and consequently the production of the line, and not for a programmed production of sheets given the absence in the first portion of the plant of a controlled cooling system necessary for the production of high-quality sheets.

The transfer bar, after a phase of heating in an induction furnace and subsequent descaling, is further processed in a second phase of finishing rolling to transform it into a strip by controlling its temperature so that at the exit of the finishing rolling mill it still has a temperature above approximately 820-850° C., which corresponds to the lower end of the austenitic temperature range for most steels.

However, the results so far, although optimal in terms of steel strip quality, have proved to be improvable in terms of plant compactness, energy savings and the current minimum strip thickness value of 0.6 mm. In addition, although reduced oxide (scale) formation on the strip surface is achieved due to the minimum dwell time of the material at temperature, through the aforementioned induction heating of the transfer bar between the roughing and finishing stages, this reduced formation has not proved sufficient to avoid the pickling stage before the anti-corrosion coating is applied.

In order to ensure the desired final rolling in the austenitic field with greater production flexibility and to further reduce the formation of scale, a plant of the type described above is known from U.S. Pat. No. 9,108,234, which also includes a second induction furnace between the descaler and the finishing mill, the heating in said second furnace taking place in a protective atmosphere that prevents oxidation of the transfer bar being substantially composed of inert gas (nitrogen) with a minimum presence of oxygen (about 5% or less). Other examples of induction heating in a protective atmosphere prior to final rolling are found in U.S. Pat. No. 8,479,550 which, however, provides for only one induction furnace after the descaler, US 2012/043049 which also provides for a reducing atmosphere using hydrogen but no roughing, and DE 19936010 which, however, does not include an induction furnace after the descaler and which for the protective atmosphere teaches the use of combustion gas produced in the plant itself instead of an inert gas in order to reduce costs, this gas being able to be distributed also in various parts of the plant before and after the induction furnace (e.g. inductive edge heater, descaler, finishing mill, exit roller conveyor, winder).

None of these prior art documents, however, envisages obtaining a strip thickness below the current limit of 0.6 mm nor considers the particular problems arising when going below this limit. In fact, none of the plants described in these documents is suitable for this purpose because of the conflicting requirements of maintaining a high temperature of the transfer bar at the entrance to the finishing mill to ensure a completely austenitic rolling of such a thin strip and therefore subject to greater cooling, and the need to limit the formation of scale despite the strong heating both in terms of time and temperature.

SUMMARY OF THE INVENTION

The purpose of the present invention is therefore to provide a solution for the continuous production of hot-rolled strips with a thickness down to 0.3 mm and a maximum width of at least 2100 mm, or whatever is the provided maximum width of the ingot mould, starting from the casting of a slab with a thickness between 40 and 150 mm without passing through intermediate plants for pickling, cold rolling and annealing, and with a limited amount of scale such that these strips are suitable to be directly coated against corrosion (particularly in galvanising lines) without undergoing specific preliminary surface conditioning treatments, particularly in pickling lines.

This result is obtained with the use of continuous production technology (so-called endless), which minimises production time and consumption and consequently reduces production costs, in particular by adopting the following measures to control the temperature of the material and limit its reduction while avoiding excessive surface oxidation of the material:

a) in order to clean the slab from the scale before entering the roughing mill (HRM) and allow a number of roughing passes from a minimum of three up to a maximum of five, at the exit of the continuous casting (caster) there is an initial thermal conditioning and descaling section comprising in sequence, in the direction of slab advancement, an induction edge heater, an induction heater for the rest of the slab surface and a water descaler;

b) in order to prevent jets of water and steam from the descaler from damaging the induction coils of the surface heater, the descaler is provided at the inlet with transversely movable shutters that rest directly on the edges of the slab, while closure on the upper and lower faces of the slab is provided by a small drive stand, a so-called pinch roll, placed adjacent to said shutters on the inlet side of the descaler facing the surface heater;

c) given the low speed of the slab at the exit of the caster, lower than 10 m/min, in order to minimise the time taken for the slab to pass from the caster to the entrance of the roughing mill, so as to minimise scale formation and temperature drops, said initial section must be as compact as possible, so that said edge heater, surface heater and descaler, the latter including pinch roll and screening shutters, occupy a space in the order of 3-5 metres in length;

d) the edge heater is equipped with a handling system which allows the efficiency of the heating system to be kept constant as the width of the slab varies, to set the optimum width of the area of the edges to be heated and to remove/lift the induction coils in the event of "waves" on the slab due to cobbles in the roughing mill;

e) the edge heater is able to heat differently the right and the left edge of the slab to ensure an optimal and homogeneous profile of the slab entering the roughing mill, even if the slab exiting the caster presents temperature inhomogeneity between the two edges;

f) the descaler is designed to have a diameter of the cooling water nozzles and a delivery pressure such that the temperature drop at the outlet of the descaler is limited to less than 10° C. between when the descaler is active and when it is inactive.

Other advantageous arrangements preferably adopted in the present invention to improve the present plant and process are:

g) constructing the second water descaler, located between the two induction furnaces before the finishing mill, with a structure similar to the first descaler mentioned above and including pinch rolls at both inlet and outlet so as to protect said two induction furnaces from water and steam jets;

h) mounting the nozzles for feeding the protective atmosphere in the finishing mill on the mobile structure of the so-called "looper" arranged between the rolling stands, i.e. a roller equipped with a strip tension sensor that can move vertically and allows the material to be arranged with a suitable loop between the stands in such a way that the speed control system varies the reciprocal speed of the stands so as to maintain constant tension on the strip i) providing a mechanical scale-breaking device, situated immediately before the second water descaler, consisting of at least three rollers arranged alternately above and below the feed line of the transfer bar and at a height sufficient to cause a plastic stretching of the surface thereof which causes a breakage of the rigid layer of scale and facilitates its removal in the subsequent water descaler;

j) in order to allow high temperatures for the winding of ultra-thin strips, up to 750° C. and in any case higher than the transformation points, providing also winding coilers close to the last rolling stand, above ("up-coilers") or below ("down-coilers") the surface of the exit roller conveyor, and preceded by a short cooling line and a high speed shear (in addition to the similar final coilers traditionally provided after a normal cooling line and the relative shear);

k) providing a first and a second mechanical descaler, located respectively between the cooling line and the shear of the close coilers and the final coilers, using counter-rotating abrasive brushes or abrasive slurry jets;

l) providing a corrosion protection coating line directly after the final coilers so that it is possible to apply said coating without the steel strip having to be previously wound onto a coiler to form coils;

m) providing a cooling tank in which the coils removed from the coilers can be immersed in water or in a slightly oxidising aqueous solution.

BRIEF DESCRIPTION OF THE DRAWINGS

Further advantages and features of the plant and process according to the present invention will be apparent to those skilled in the art from the following detailed and non-limiting description of some of its embodiments with reference to the appended drawings in which.

DETAILED DESCRIPTION OF THE INVENTION

Figure 1A:
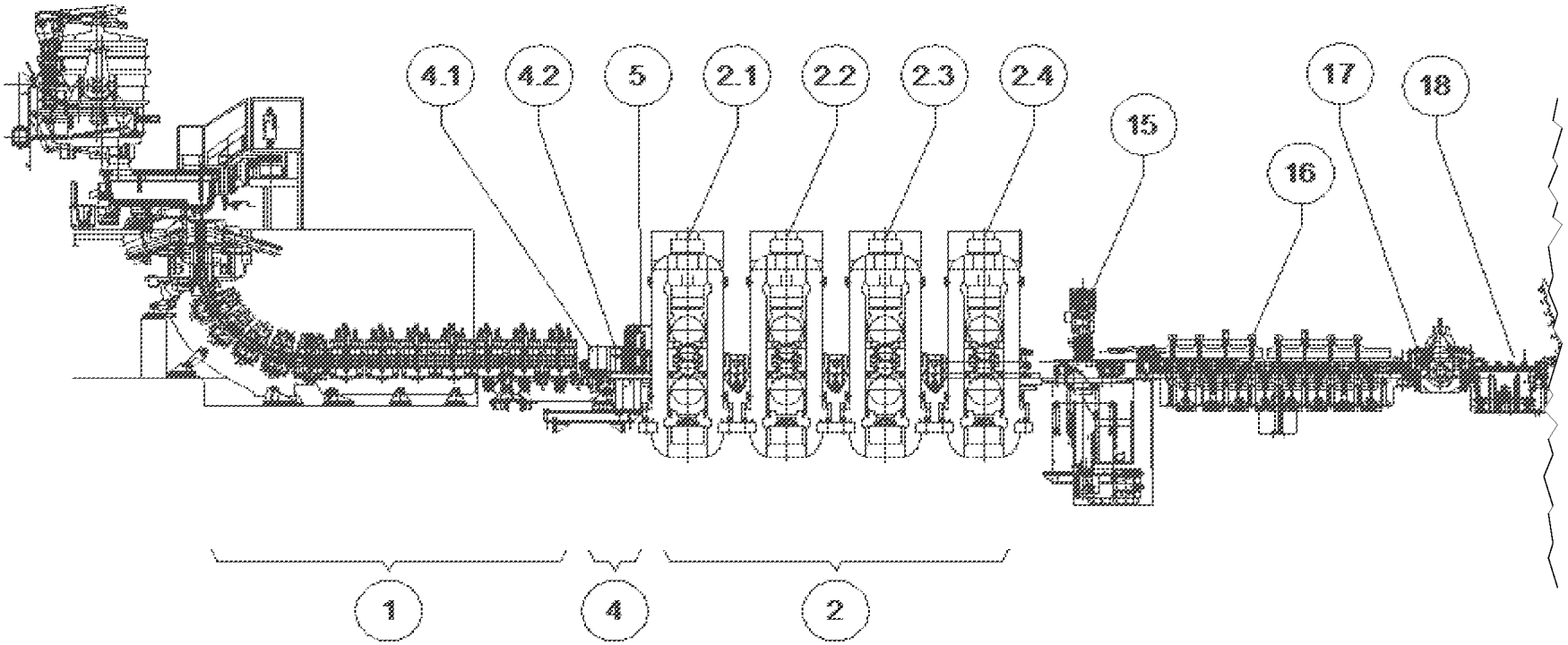
FIGS. 1*a*, 1*b*, 1*c* show a schematic view of the plant in an embodiment comprising all optional components except the anti-corrosion coating line.
Figure 1B:
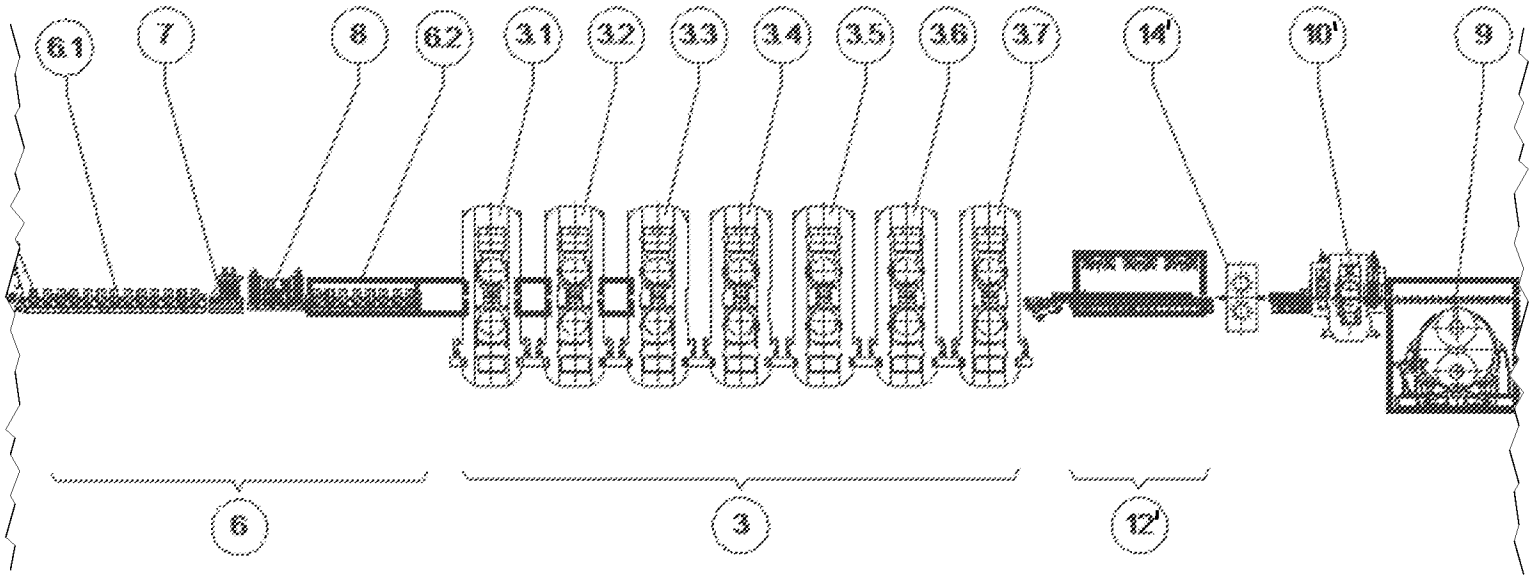
Figure 1C:
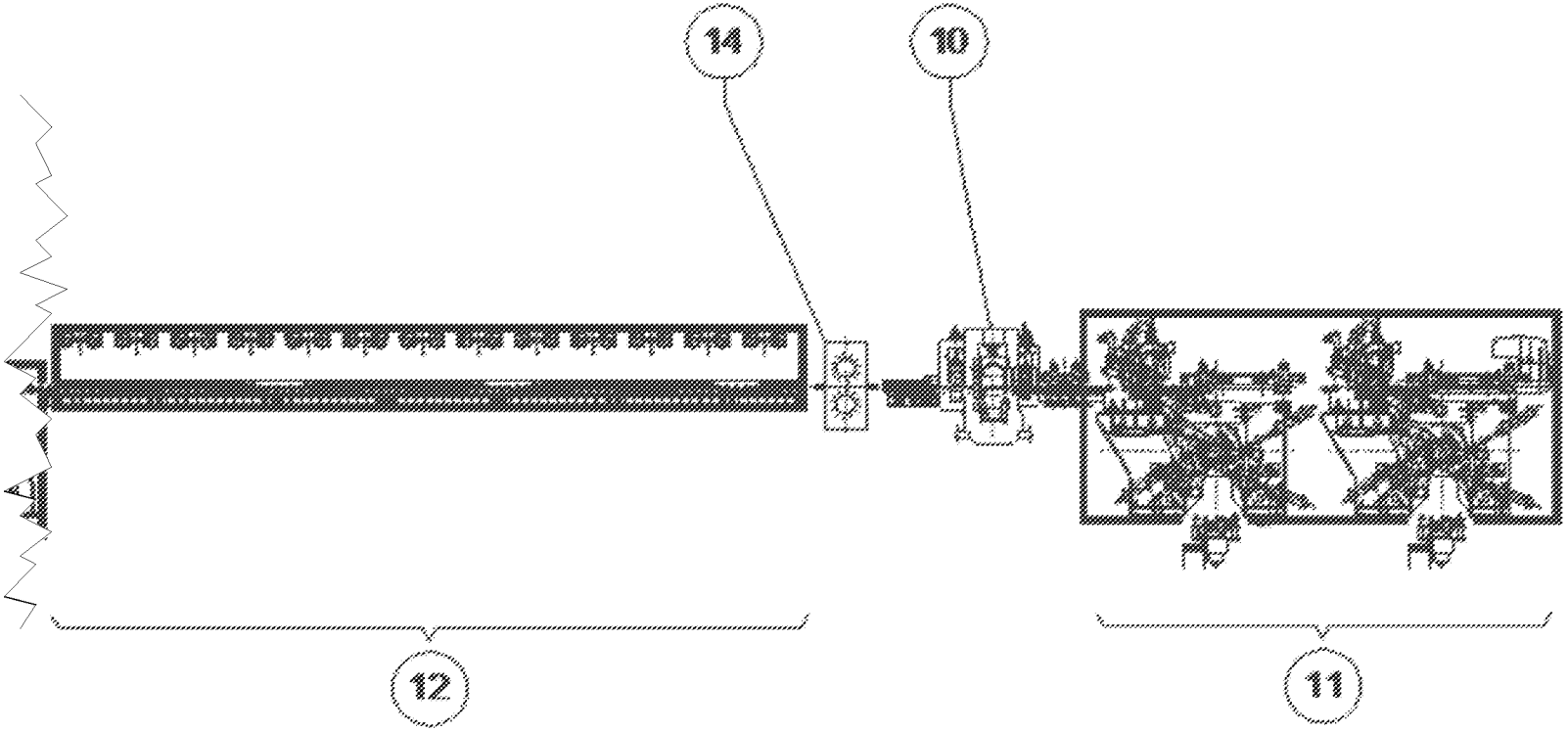

Referring to FIGS. 1*a*-1*c*, there is seen that a plant according to the present invention traditionally comprises a caster 1 for continuous casting of thin or medium slabs with a thickness of 40-150 mm, followed by a roughing mill (HRM) 2, in the illustrated example formed by four stands 2.1-2.4 but could also be three or five, which transforms slabs into transfer bars with a thickness ≤8 mm. Experimental tests have shown how a limited reduction in thickness (≤20%) in the first roughing stand 2.1 can allow the surface stresses to be contained within the strength limits of the coarse austenite that constitutes the slab as a casting. In this way, the almost static recrystallisation of the surface in the first roughing step, particularly for steels with the presence of micro-alloying, can allow to carry out without defects or cracks the subsequent considerable reductions in thickness necessary to obtain transfer bars suitable for the production of ultra-thin strips.

After HRM 2, an emergency system is arranged for the production and removal of rough sheets in case of problems in the portion of the plant downstream of the HRM, such system comprising a pendulum shear 15, a stacker 16 for the extraction of sheets, a rotary shear 17 and a loop-former 18, the latter two devices having the purpose of freeing the line from the material between the pendulum shear 15 and the subsequent first induction furnace 6.1 in the initial cobble phase.

Said first induction furnace 6.1 is the first component of the central thermal conditioning and descaling section 6 further comprising in sequence, in the direction of advancement of the transfer bar, a mechanical device 7 (optional) for breaking the scale of the type described above and formed in this case by five rollers, a water descaler 8 and a second induction furnace 6.2. In this way, the transfer bar undergoes a further heating before entering the adjacent finishing mill 3, which in the illustrated example is formed by seven stands 3.1-3.7 but could also be five or six. Finally, the strip is cooled in a controlled manner by a cooling roller conveyor 12 followed by a final winding station comprising a flying shear 10 and at least one pair of single coilers 11.

In order to allow high winding temperatures for ultra-thin strips, as mentioned above, the plant preferably also comprises close winding coilers, i.e. preceding the aforementioned elements 10-12, in the form of a pair of "carousel" coilers 9, arranged in proximity to the last rolling stand 3.7 and preceded by a short cooling roller conveyor 12' and a high speed shear 10' analogous to said elements 10, 12, although the roller conveyor 12' may preferably be made to perform ultra-rapid cooling in order to obtain a scale that is more easily removable in the subsequent processes of applying the protective coating.

Between each pair of elements 10, 12 and 10', 12' there is also preferably arranged a respective mechanical descaler 14, 14' of a known type, and therefore not further described, which uses counter-rotating brushes or jets of abrasive slurry for a final surface treatment of the strip before it is coiled onto coilers 9 or 11.

As mentioned above, the plant depicted in FIGS. 1*a*-1*c* also includes a system for dispensing a protective atmosphere in certain zones thereof, indicated schematically by thick line boxes, which in the example illustrated extend at least from the entrance of the second induction furnace 6.2 to the third stand 3.3 of the finishing mill 3, preferably up to the last stand, and even more preferably also in the subsequent cooling and winding stations. Obviously, it would also be possible to envisage the extension of this system to other components of the plant as described in the above-mentioned prior art.

Figure 3:
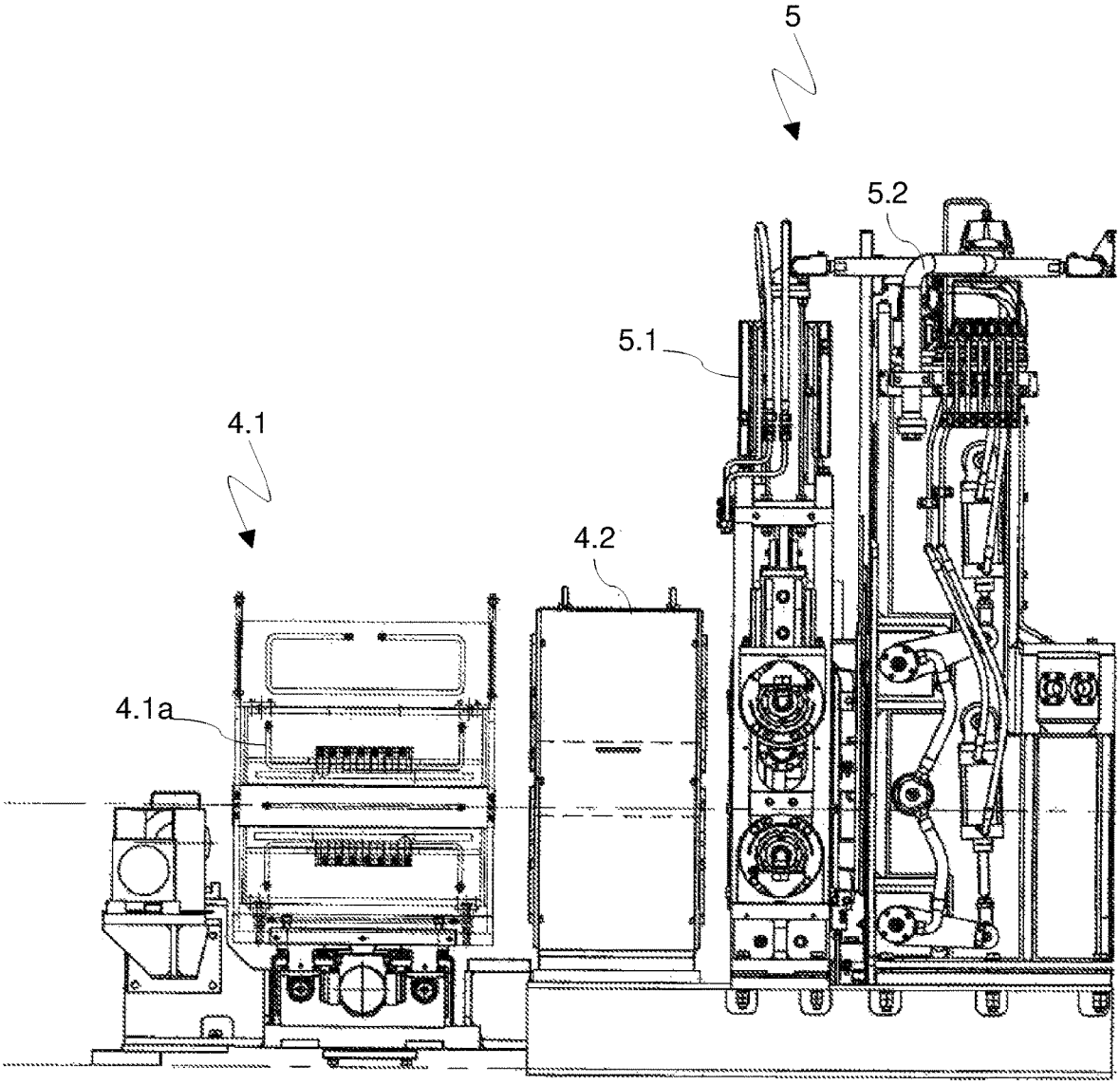
FIG. 3 is a side view of the initial thermal conditioning and descaling section.

A first innovative aspect of the present invention, as mentioned above, is the presence of an initial thermal conditioning and descaling section 4 arranged between the outlet of caster 1 and HRM 2, and designed so as to have a length of only slightly more than three metres to minimise the passage time between said two components. Said section 4 comprises an induction edge heater 4.1, an induction heater 4.2 and a water descaler 5 better illustrated in detail in FIGS. 3 to 5.

More specifically, the edge heater 4.1 is preferably designed to operate with transverse flux using side coils 4.1*a* in a "channel" configuration with flux concentrators, with the dual purpose of increasing the efficiency of the heating system and concentrating the magnetic flux on the chosen area of the slab to be heated. Furthermore, it is able to heat differently the right and the left edge of the slab thanks to the presence of two frequency converters, one for each coil 4.1*a*, instead of only one converter for the whole device as it is usually provided. From the experimental tests carried out by the applicant, it results that the width of the band to be heated should preferably reach up to 150 mm from the edge and that the optimum temperature rise in said band is up to 120° C. to avoid melting of the scale.

The edge heater 4.1 is provided with a handling system which performs a transversal movement to adapt the device to the slab width, to set the width of the area of the edges to be heated and to move away (and, if necessary, to lift by rotation) coils 4.1*a* from the edges of the slab in case there are "waves" on the slab due to cobbles in the roughing mill. Such a handling system can be realized, for example, by placing each coil 4.1*a* on a slide mobile along a transversal guide under the action of an actuator such as an electric motor driving a screw jack.

The induction heater 4.2 comprises a surface heating coil, designed to integrate with the edge heater 4.1, which can be controlled in such a way that the temperature increase of the slab reaches values of up to a maximum of 150° C., thus preventing melting of the slab.

Figure 4:
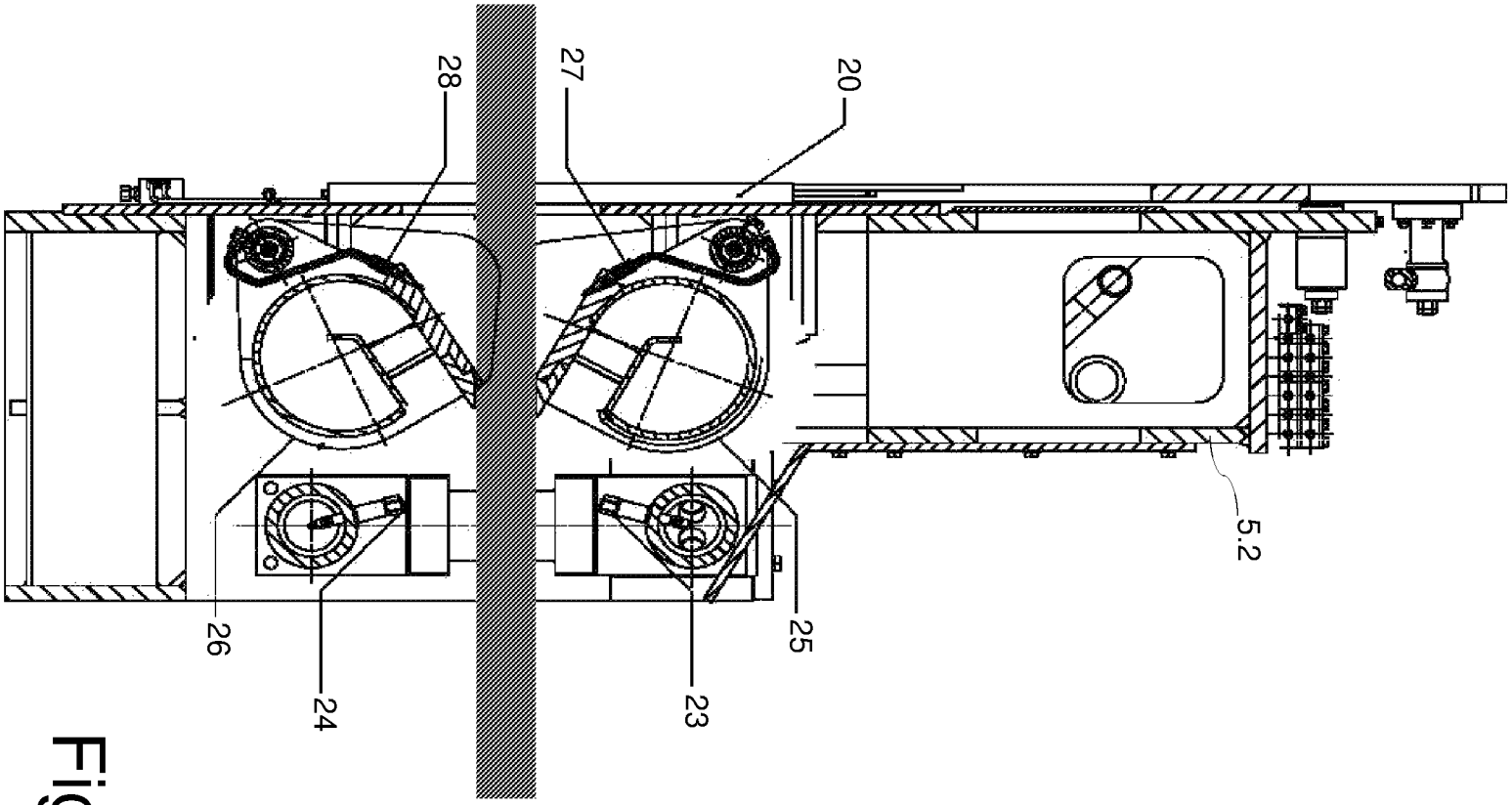
FIG. 4 is a schematic view in vertical section of the descaler of FIG. 3.
Figure 5:
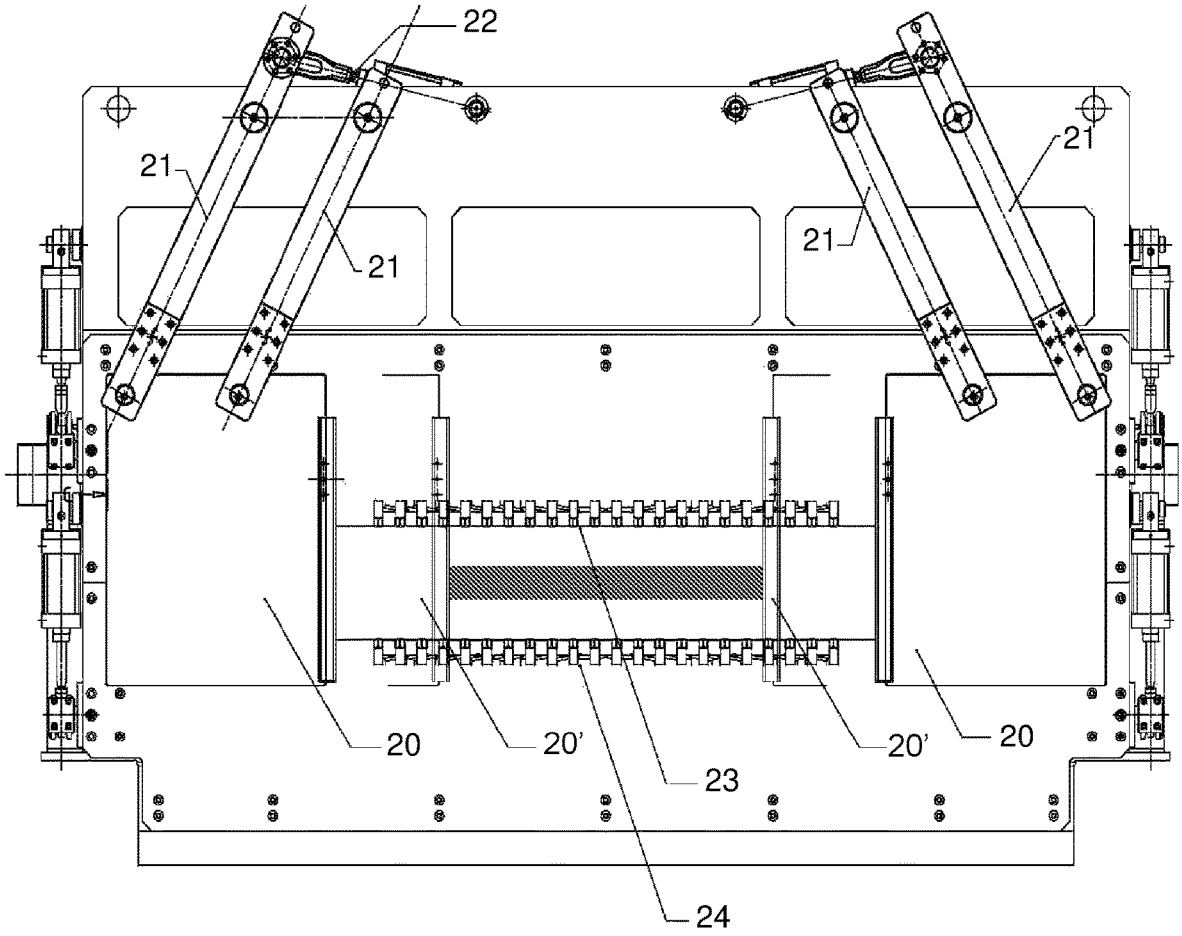
FIG. 5 is a frontal view in transparency showing some components of the descaler of FIG. 3.

The subsequent descaler 5 consists of the pinch roll 5.1, on the side towards the induction heater 4.2, and the actual descaler 5.2 on the side towards the HRM 2. As shown in FIGS. 4-5, in order to avoid that jets of water and steam coming from descaler 5.2 can damage the induction coils of heater 4.2, descaler 5.2 is provided with transversely movable shutters 20 at the inlet, which rest directly on the edges of the slab, while the closure on the upper and lower faces of the slab is provided by the pinch roll 5.1.

More specifically, in the embodiment illustrated in FIG. 5, each shutter 20 is mounted on a parallelogram support formed by a pair of parallel arms 21 pivoted between shutter 20 and the structure of descaler 5.2 and moved by an actuator 22. Note that in FIG. 5 shutters 20 are shown in an open position and also partially in a closed position 20' abutting on the edges of the slab.

The water descaling is carried out by means of a row 23 of upper nozzles and a row 24 of lower nozzles arranged transversely to the slab and with the nozzles inclined to deliver a jet in the opposite direction to the direction of movement of the slab. An upper scroll 25 and a lower scroll 26, arranged specularly upstream of the nozzles and with their openings facing the nozzles, collect most of the water through a lip in contact with the slab and convey it to their ends where it is discharged.

In addition, a row 27 of upper nozzles and a row 28 of lower nozzles arranged transversely to the slab upstream of the scrolls and with the nozzles inclined to deliver a jet of air in the direction of movement of the slab eliminate residual water. The combination of components 5.1, 20, 25, 26, 27 and 28 ensures that the induction coils of heater 4.2 are not damaged by the water used in descaler 5.

As mentioned above, descaler 5.2 is designed to limit the temperature drop to less than 10° C. between when it is active and when it is inactive, and to this end the cooling water pressure is less than 150 bar and the diameter of the nozzles is less than 3 mm. Note that the rows 23, 24 of the water nozzles shown in FIG. 5 (where scrolls 25, 26 and rows 27, 28 of the air nozzles are omitted) are wider than the slab because they are sized for the maximum width of the slab, and the nozzles outside the slab being processed can be closed with plugs or the jets from them "cancel out" by colliding and in this case the upper and lower nozzles must be arranged in opposite positions, be vertically aligned and have the same angle of inclination (e.g. 5°).

Figure 6:
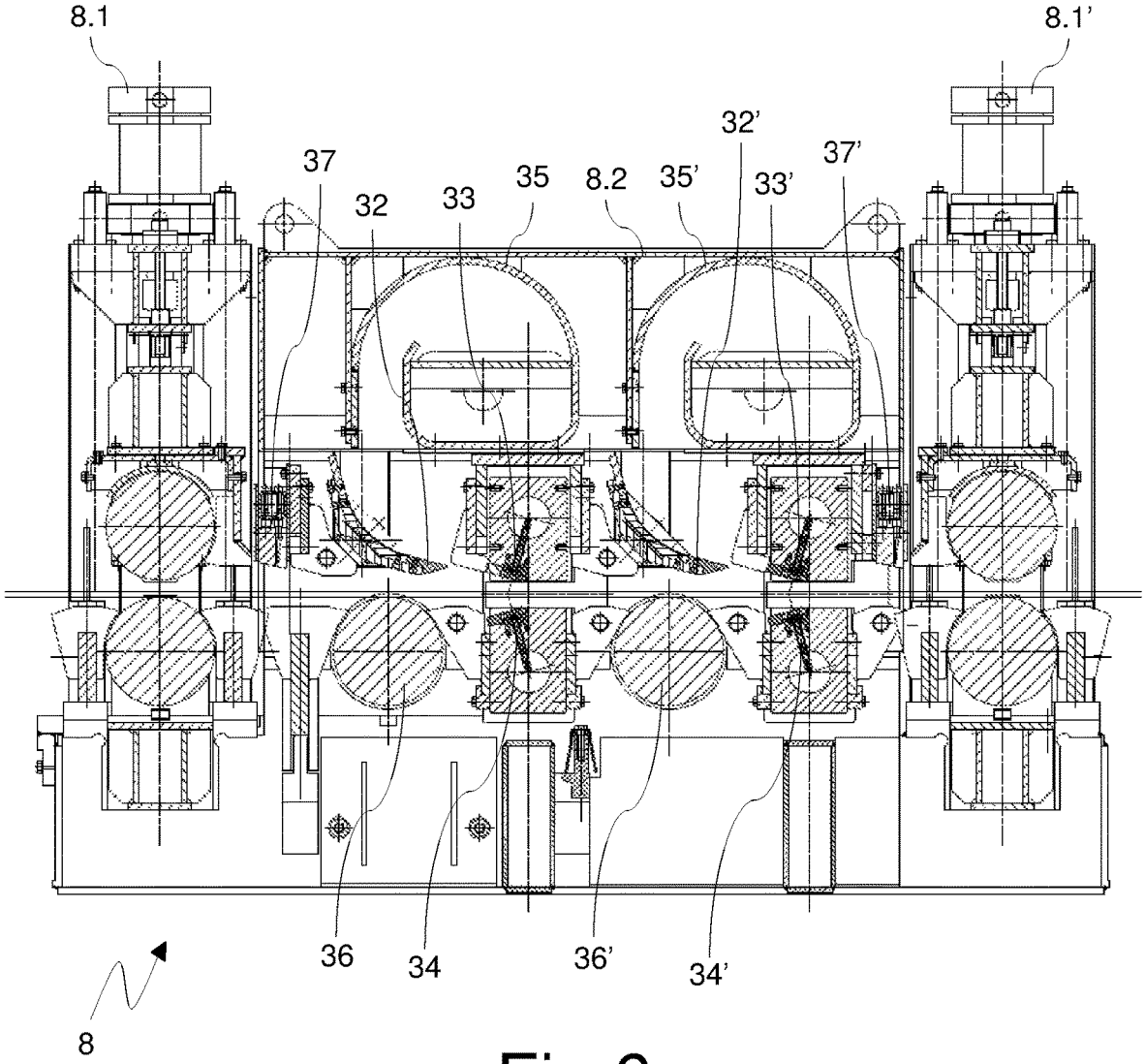
FIG. 6 is a schematic view in vertical section of the second water descaler.

The second water descaler 8, illustrated in FIG. 6, has a similar structure to the first water descaler 5, but it is substantially double, since being arranged between the two induction ovens 6.1 and 6.2 it has to prevent water and steam from escaping both upstream and downstream. It therefore comprises a first inlet pinch roll 8.1, on the side towards the first induction furnace 6.1, the actual descaler 8.2 and a second outlet pinch roll 8.1' on the side towards the second induction furnace 6.2. Note that in this case transverse shutters analogous to shutters 20 of the first descaler 5 can be omitted since the latter have to close a lateral passage of a height equal to the thickness of the slab coming from the caster 1, i.e. 40-150 mm, whereas the thickness of the transfer bar entering the second descaler 8 is of the order of 5-20 mm, so the potential lateral leakage of water is much less.

Furthermore, since the second descaler 8 is followed by the second induction furnace 6.2 which significantly increases the temperature of the transfer bar before the final rolling, the descaling can be stronger even at the expense of a greater temperature reduction. Therefore, there is provided a first row 33 of upper nozzles with a corresponding row 34 of lower nozzles, also arranged transversely to the transfer bar and with the nozzles inclined to deliver a jet in a direction opposite to the direction of movement of the bar, as well as an identical second row 33' of upper nozzles with a corresponding row 34' of lower nozzles. Preferably, the second rows 33', 34' are transversely staggered by half pitch, where the pitch is the spacing between two nozzles of a row, with respect to the first rows 33, 34 so that the two successive rows 33, 33' and 34, 34' completely cover the upper and lower surface of the bar, respectively, so as to increase the efficiency of the hydraulic descaling process by eliminating inefficiencies manifested in the overlapping bands of adjacent nozzles of each row.

The two rows 33, 33' of upper nozzles are similarly preceded by an upper scroll 35, 35' which, however, in this case is separated from the lip 32, 32' which contacts the upper surface of the transfer bar and is movable between a rest position, illustrated in FIG. 6, and a working position in which it rotates clockwise and aligns with scroll 35, 35'. Furthermore, the first lip 32 is similarly preceded by a first row 37 of upper nozzles arranged transversely to the transfer bar to deliver an air jet which in this case is substantially perpendicular to the upper surface of the bar, while an identical second row 37' of upper air nozzles is arranged downstream of the second row 33' of water upper nozzles.

Since descaler 8 is not required to be as compact in length as descaler 5, the transfer bar can be supported below by ordinary transport rollers 36, 36' which perform a closing function on the lower side similar to that of the lower scroll 26. For this reason, descaler 8 does not comprise lower components corresponding to the upper components 32, 32', 37, 37' but only the lower water nozzles 34, 34'. Nevertheless, the combination of components 8.1, 8.1', 32, 32', 35, 35', 36, 36', 37 and 37' ensures that the induction coils of furnaces 6.1 and 6.2 are not damaged by the water used in descaler 8. As mentioned above, since descaler 8 is designed for stronger descaling, the cooling water pressure can be up to 380 bar, again with nozzles of less than 3 mm in diameter, even though this can result in a reduction of up to 150-200° C. in the temperature of the transfer bar. Obviously, even in descaler 8 the rows 33, 34 and 33', 34' of the water nozzles are sized for the maximum width of the bar, with the nozzles outside the bar being processed that are closed with plugs or with jets that "cancel out" by colliding, and in this case the upper and lower nozzles must be vertically aligned and have the same angle of inclination (e.g. 5°).

Figure 7:
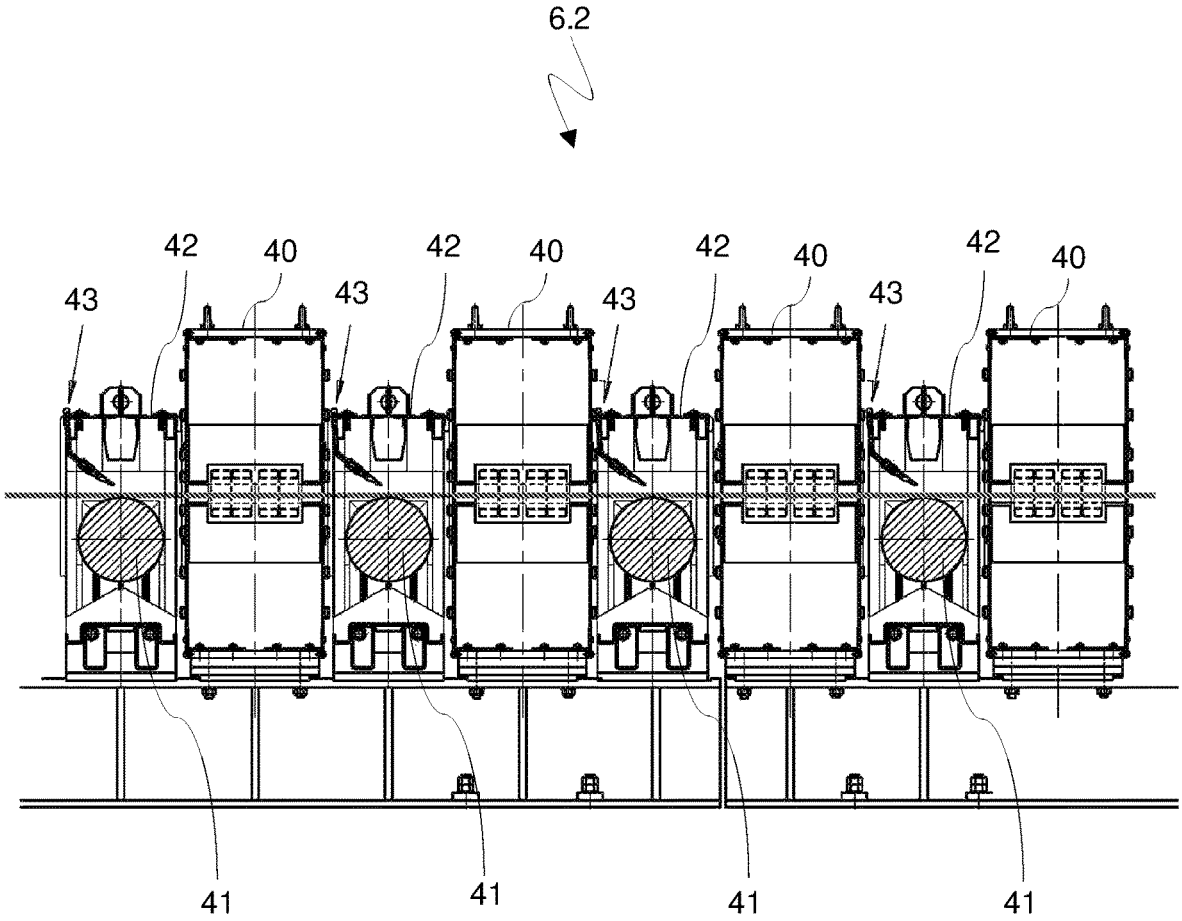
FIG. 7 is a schematic view in vertical section of some components of the second induction furnace preceding the finishing mill.

Referring now to FIG. 7, which shows four inductors 40 of the second induction furnace 6.2, it can be seen that the transfer bar is supported by lower rollers 41 arranged in the spaces between inductors 40, said spaces being closed at the bottom by the support structure of said rollers 41 and at the top by removable covers 42. It is therefore advantageous to mount on said covers 42 transverse rows of nozzles 43, so as to obtain a series of chambers into which the protective atmosphere can be injected by means of said nozzles 43.

This protective atmosphere can be of various types as long as it has a very low or zero oxygen content so as to limit or prevent surface oxidation of the material. Typically, the oxygen is reduced by continuously delivering nitrogen from nozzles 43 until a low-oxidising atmosphere with a maximum of 3% vol. oxygen content is obtained. Other possibilities are the use of an atmosphere composed entirely of inert gas (nitrogen, argon, etc.), or the addition of hydrogen to the inert gas up to a maximum content of 5% vol. to obtain a slightly reducing atmosphere.

Figure 8:
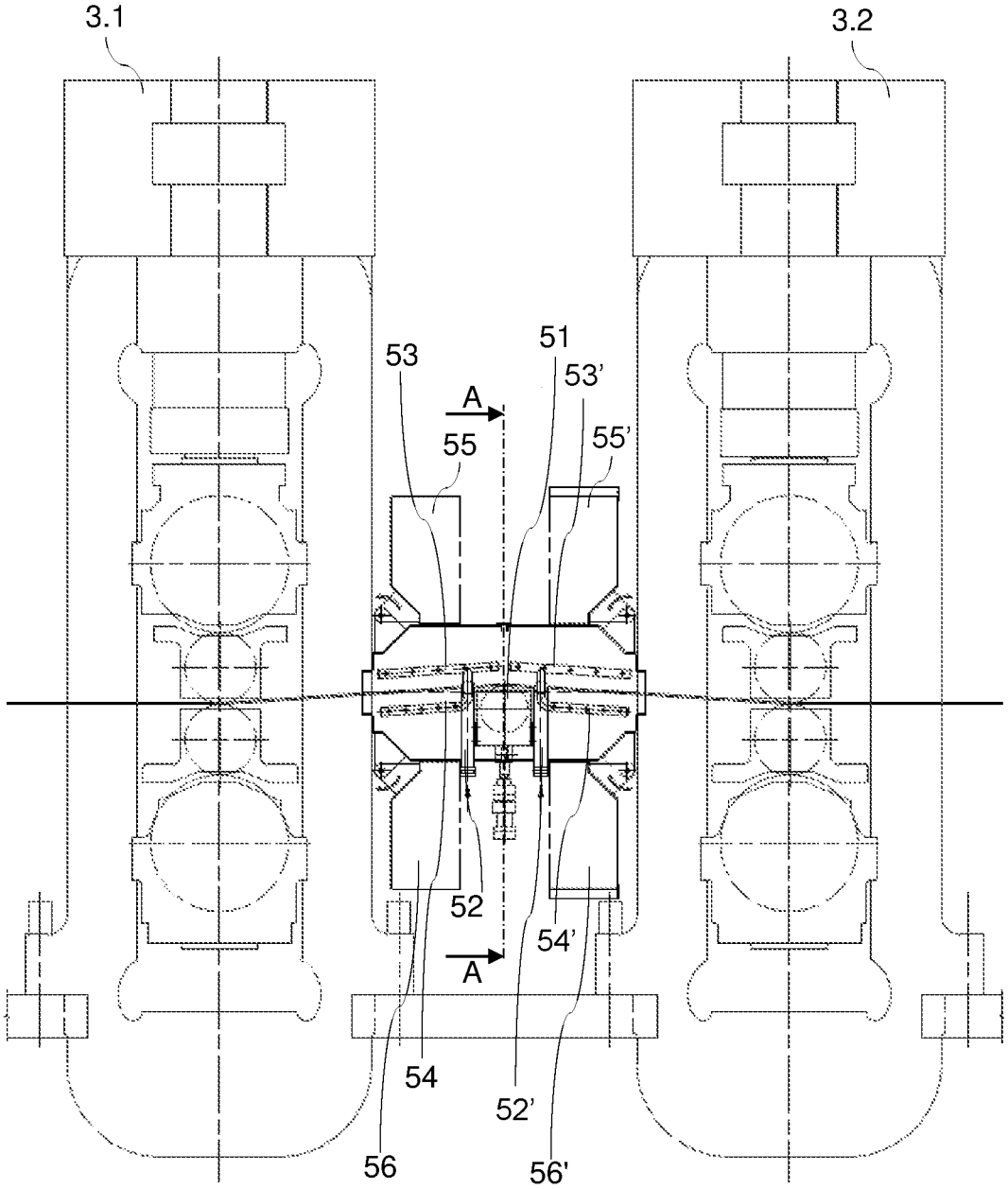
FIG. 8 is a schematic view in vertical section of a first embodiment of the protective atmosphere dispensing device placed between two stands of the finishing mill.
Figure 9:
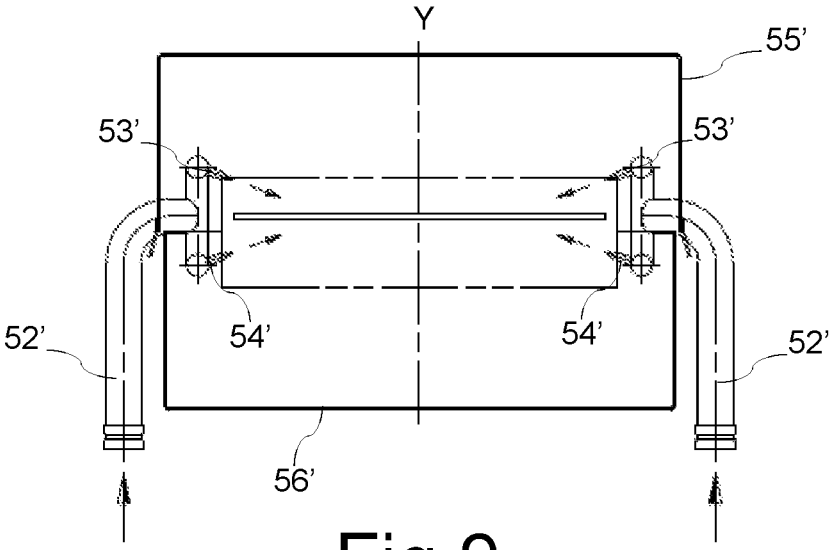
FIG. 9 is a schematic view in vertical section along line A-A of FIG. 8 of a detail of the dispensing device.

As mentioned above, a similar solution can be envisaged for obtaining chambers between the stands of the finishing mill 3 by mounting the nozzles on the structure of the looper arranged in the space between two stands. A first embodiment of this solution is illustrated in FIGS. 8 and 9, which show how the protective atmosphere feeding system has a double mirror symmetry both with respect to the section plane A-A indicated in FIG. 8, i.e. with respect to the upstream and downstream side of looper 51, and with respect to the vertical longitudinal midplane Y of the strip indicated in FIG. 9, i.e. with respect to the right and left side of the strip. In the example illustrated in these figures, the system is arranged between the first two stands 3.1 and 3.2 of the finishing mill 3, but it is clear that the same system may be arranged between any pair of stands of this mill.

This system comprises on each side of the strip a pair of vertical feed ducts 52, 52' mounted on the structure of looper 51, respectively on the upstream and downstream side thereof, and from each of said ducts 52, 52' branch out two rows of substantially horizontal nozzles arranged longitudinally above and below the strip and parallel to its edges. More specifically, each of the two rows 53, 53' of upper nozzles extends towards both stands 3.1, 3.2 almost up to the plane of section A-A passing through the centre of looper 51, while each of the two rows 54, 54' of lower nozzles extends only towards the adjacent stand 3.1, 3.2 respectively. Moreover, as shown in the detail of FIG. 9, the nozzles are inclined in the vertical plane with an orientation towards the surface of the strip.

To limit the dispersion of the protective atmosphere, the rows of nozzles are preferably enclosed within a chamber formed by a pair of upper flaps 55, 55' and a pair of lower flaps 56, 56' which are obviously shaped to allow the strip to pass through the chamber. More specifically, each of the flaps is pivoted at one of its external ends to allow the opening of the containment chamber by means of a rotation of 90°, as indicated in FIG. 8 wherein the closed chamber is depicted with a thicker line while the numerical references 55, 55', 56 and 56' indicate the flaps rotated in an open position.

Figure 11:
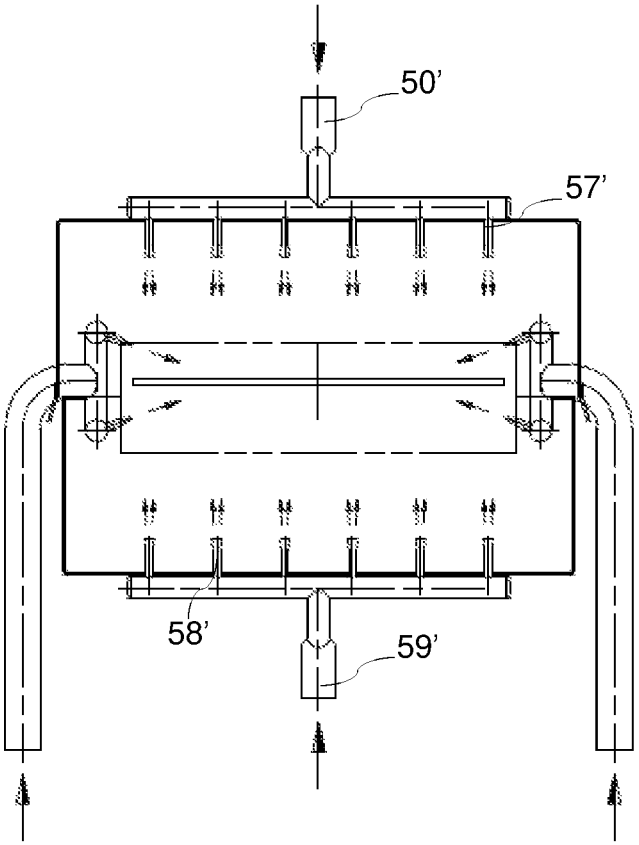
FIG. 11 is a schematic view in vertical section along line B-B of FIG. 10 of a detail of the dispensing device.
Figure 10:
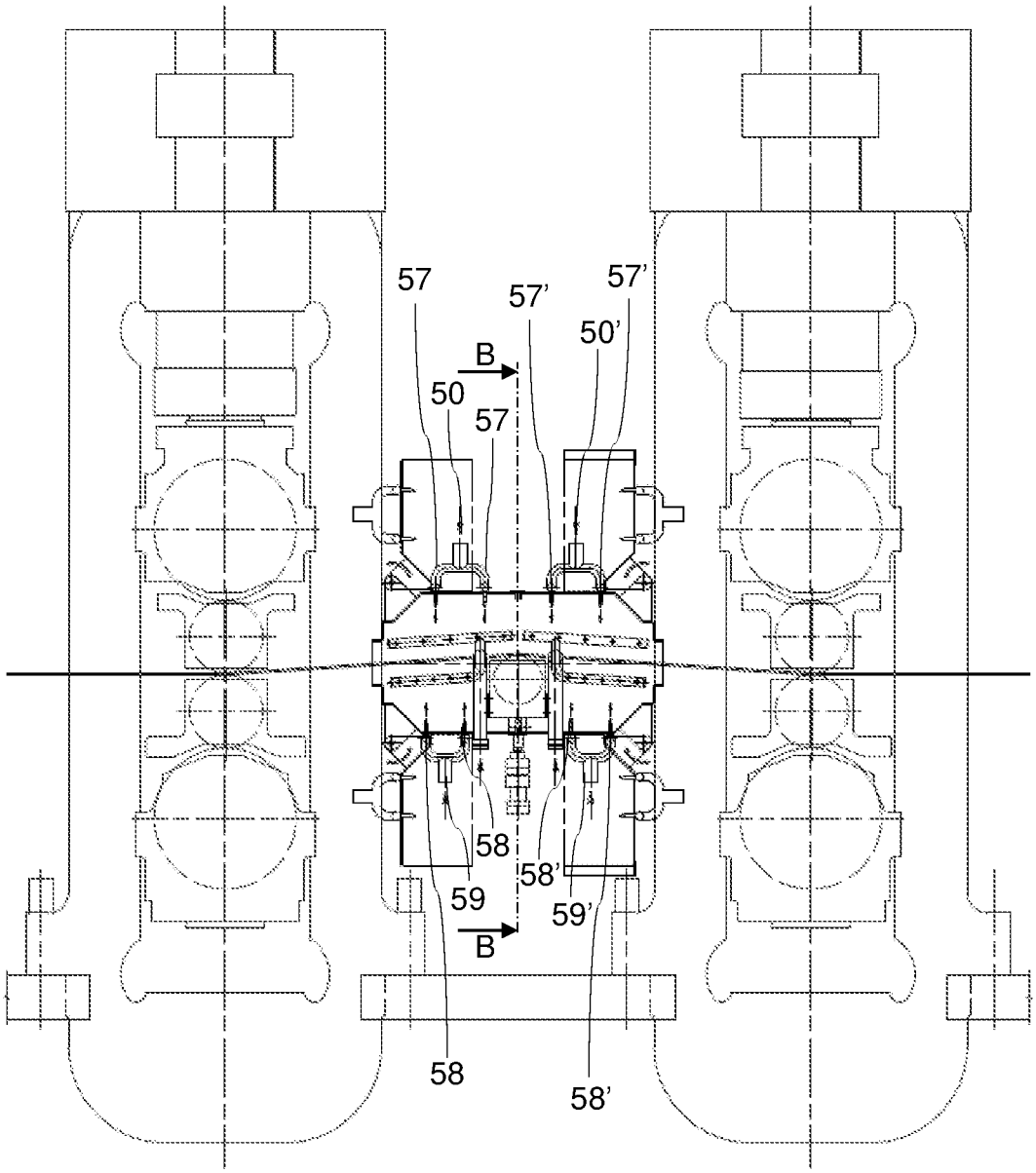
FIG. 10 is a view similar to FIG. 8 of a second embodiment of the protective atmosphere dispensing device.

A second embodiment of the system analogous to the previous one is illustrated in FIGS. 10 and 11 showing the same elements of FIGS. 8 and 9, whose numerical references are therefore not repeated, only with the addition on the external face of each flap of at least two parallel rows 57, 57', 58, 58' of transversal nozzles. The protective atmosphere reaches each pair of rows through a respective feed duct 50, 50', 59, 59' and the nozzles are oriented in a direction substantially perpendicular to the upper and lower surfaces of the strip.

Figure 12:
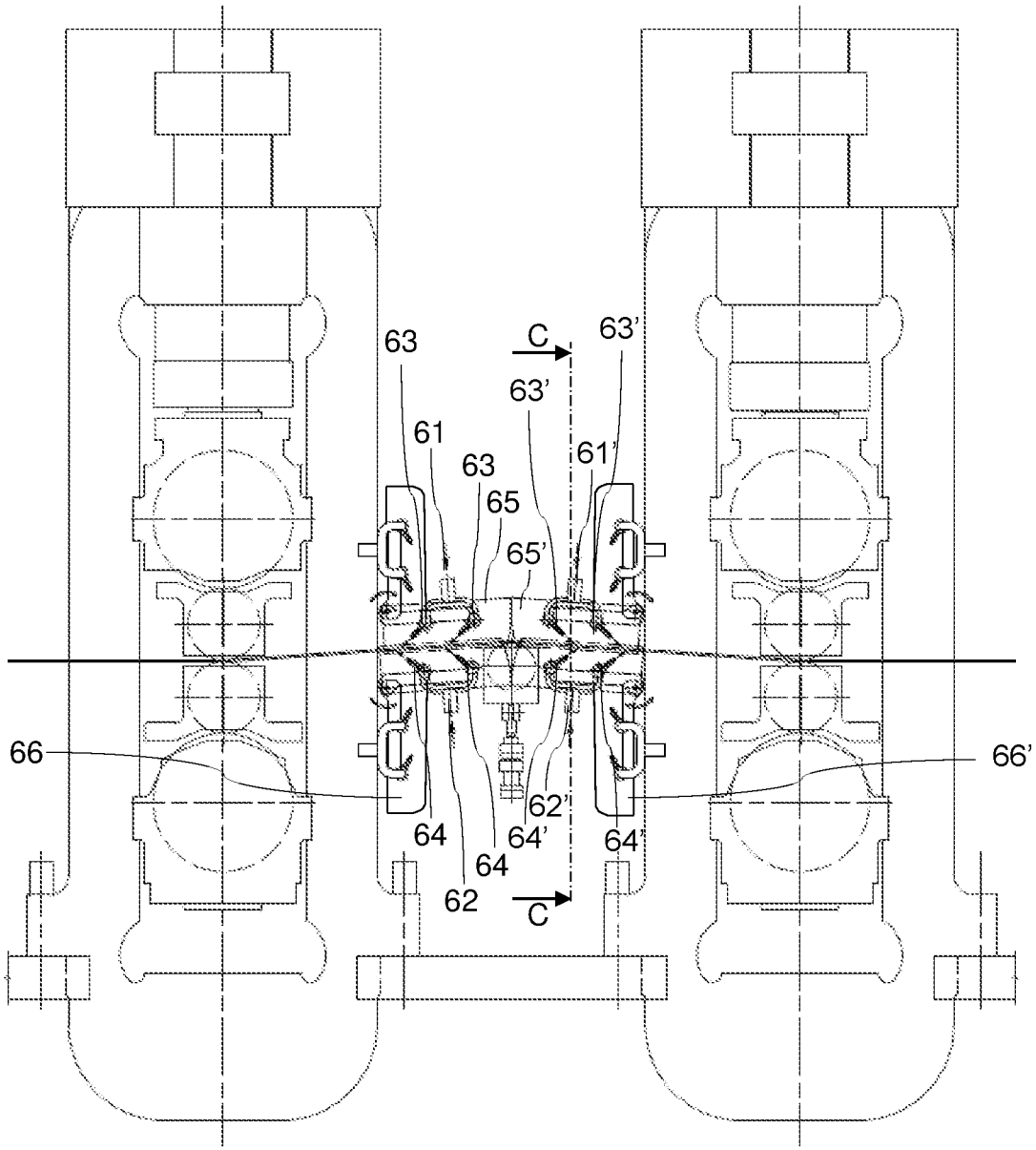
FIG. 12 is a view similar to FIG. 8 of a third embodiment of the protective atmosphere dispensing device.
Figure 13:
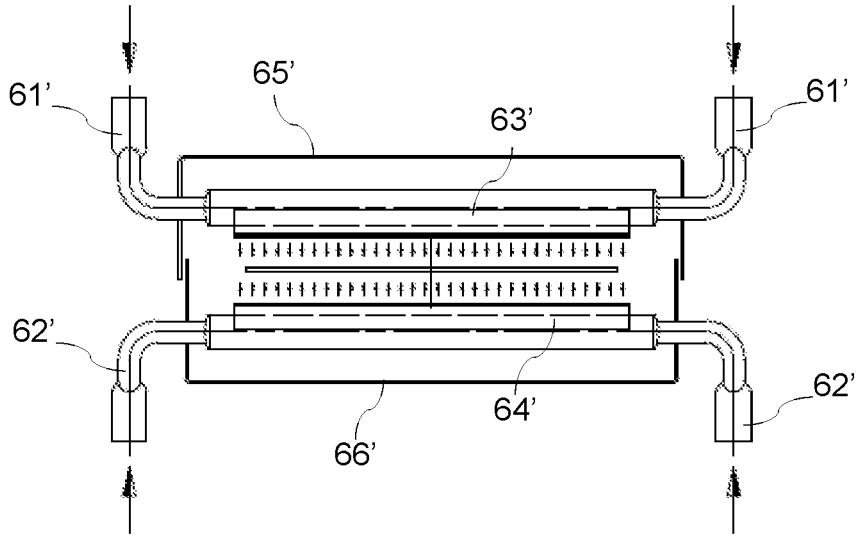
FIG. 13 is a schematic view in vertical section along line C-C of FIG. 12 of a detail of the dispensing device.

Finally, in FIGS. 12 and 13 a third embodiment of the system is illustrated, which in practice is obtained from the previous one by removing the elements of FIGS. 8 and 9 and keeping only the at least two transversal parallel rows 63, 63', 64, 64' arranged on respective flaps 65, 65', 66, 66' and fed through respective ducts 61, 61', 62, 62'. The differences with respect to the analogous elements shown in FIGS. 10, 11 are as follows:

- the multiple nozzles 57, 57', 58, 58' are replaced by a single nozzle of substantially the same width as the strip, i.e. a slit;
- the nozzles are not oriented in a direction substantially perpendicular to the upper and lower surfaces of the strip but are oriented with an inclination towards the adjacent rolling stand 3.1 and 3.2 respectively;
- the protective atmosphere is fed to each pair of transverse rows 63, 63', 64, 64' not through a single central duct, as in the second embodiment, but through two lateral ducts 61, 61', 62, 62' as in the first embodiment of FIGS. 8 and 9.

Figure 2:
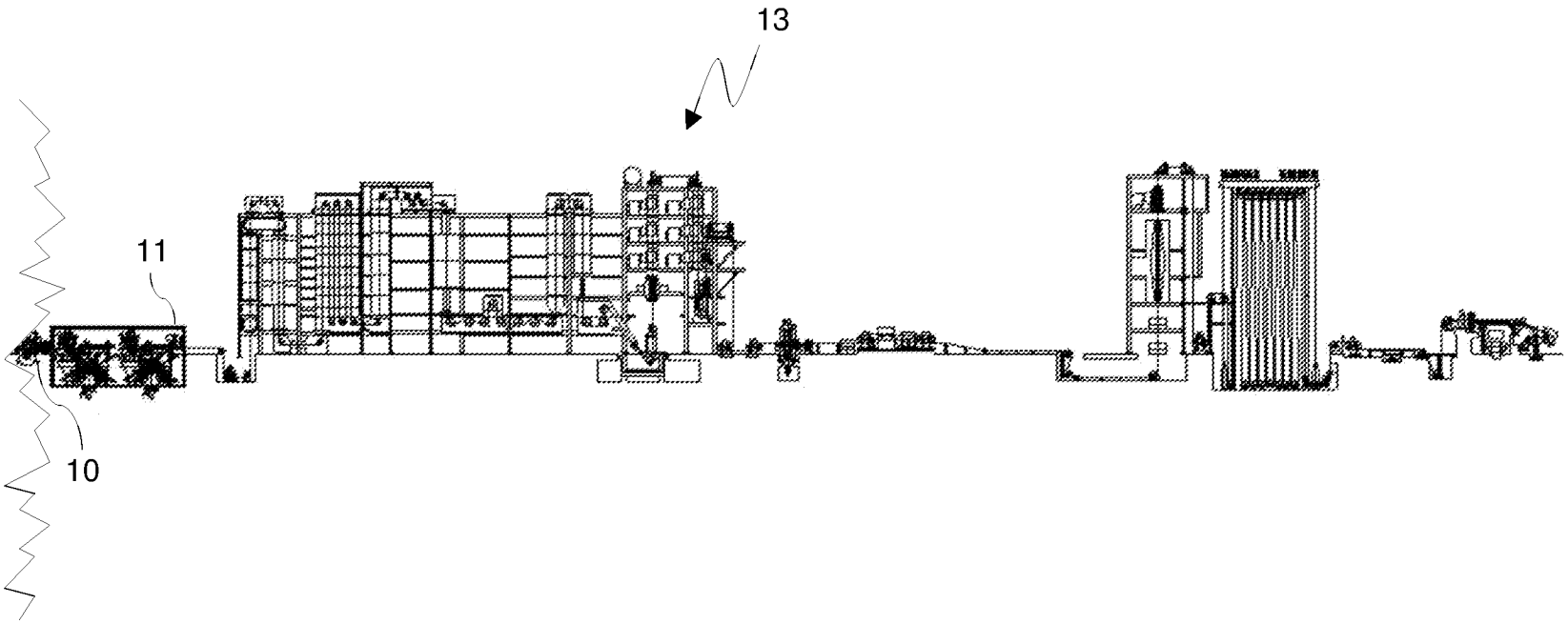
FIG. 2 is a schematic view showing only the anticorrosion coating line connected to the end of the plant of FIGS. 1*a*-1*c;*

As mentioned above, the plant described above can be integrated with a line 13 for the application of a protective coating, typically a galvanising line, connected directly downstream of the final coilers 11 as shown in FIG. 2. In this way the plant can produce both coils of uncoated strip that are wound on coilers 9 or 11, and coils of coated strip that are wound in a further winding station at the end of line 13.

Another possible alternative is to perform a liquid cooling of the coil wound on coilers 9 or 11 in a tank (not shown) containing water or a slightly oxidizing aqueous solution. This allows to obtain a scale which is more easily removable in the subsequent processes of applying the protective coating.

Furthermore, thermal scanners, not shown in the figure, are preferably positioned at the exit of caster 1, HRM 2, the first induction furnace 6.1, descaler 8, the second induction furnace 6.2, the finishing mill 3 and the cooling roller conveyors 12, 12'.

These thermal scanners are operatively connected to a temperature control and management system which, thanks also to thermocouples (not shown) inserted in the copper plates of the ingot mould, influences the temperature distribution of the steel in the mould by means of an electromagnetic brake (EMBR) inserted in the mould, also not shown. In fact, the thermal scanners and thermocouples provide an image of the temperature distribution in the slab, giving the control system the ability to take corrective action on the operating parameters of the EMBR and of the slab cooling system. This control system obviously also acts on all the other components that actively influence the temperature of the material being processed, both during heating (4.1, 4.2, 6.1, 6.2) and cooling (5.2, 7, 8.2, 12, 12', 14, 14').

By way of example, the following table represents a possible rolling sheet for the production of an ultra-thin strip of thickness 0.4 mm with a winding temperature on the final coilers of 680° C.:

| Stand | | 2.1 | 2.2 | 2.3 | 2.4 |
|---|---|---|---|---|---|
| Entry temperature | [° C.] | 1250 | | | |
| Entry speed | [m/sec] | 0.1 | | | |
| Entry thickness | [mm] | 90 | 40.5 | 18.2 | 10 |
| Exit thickness | [mm] | 40.5 | 18.2 | 10 | 6.5 |
| Reduction | [%] | 55 | 55 | 45 | 35 |
| Exit temperature | [° C.] | | | | 970 |

| Stand | | 3.1 | 3.2 | 3.3 | 3.4 | 3.5 | 3.6 | 3.7 |
|---|---|---|---|---|---|---|---|---|
| Entry temperature | [° C.] | 1150 | | | | | | |
| Entry speed | [m/sec] | 1.38 | | | | | | |
| Entry thickness | [mm] | 6.5 | 2.92 | 1.6 | 0.97 | 0.68 | 0.54 | 0.46 |
| Exit thickness | [mm] | 2.92 | 1.6 | 0.97 | 0.68 | 0.54 | 0.46 | 0.4 |
| Reduction | [%] | 55 | 45 | 40 | 30 | 20 | 15 | 13 |
| Exit temperature | [° C.] | | | | | | | 870 |
| Exit speed | [m/sec] | | | | | | | 22.6 |

A corresponding production process using the above-described plant in its most complete embodiment therefore comprises the following sequence of steps:

(a) continuous casting of thin or medium slabs (1);
(b) induction heating (4.1) of the slab edges;
(c) induction heating (4.2) of the rest of the slab surface
(d) first water descaling (5.2);
(e) rough rolling in 3-5 passes to obtain a transfer bar;
(f) first induction heating (6.1) of the transfer bar
(g) mechanical breaking (7) of the scale;
(h) second water descaling (8.2);
(i) second induction heating of the transfer bar;
(j) finishing rolling in 5-7 passes to obtain the strip;
(k) controlled cooling (12; 12') of the strip;
(l) mechanical descaling (14; 14');
(m) cutting of the strip (10; 10') and winding on a coiler (9; 11); or
(n) direct passage of the strip to a step (13) of application of a protective coating with final winding;

wherein at least phases (i) and (j), at least up to the third pass, and preferably also phases (k) and (m), in the winding part, are carried out in a protective atmosphere that is slightly oxidizing, inert or slightly reducing as described above.

It is clear that the embodiments of the plant and process according to the invention described and illustrated above are only examples which are susceptible to numerous variations. For example, although all the rows of nozzles described above and shown in FIGS. 4-6 and 8-11 are formed by a plurality of nozzles arranged with a constant pitch, it would also be possible to provide nozzles with different pitches depending on the areas and/or to replace all or part of the nozzles with a slit extending continuously as shown in FIG. 13. Similarly, both the close coilers and the final coilers may be implemented as carousel coilers 9 or single coilers 11, whereby the plant may comprise any combination thereof.

Furthermore, it is clear that for reasons of space and/or cost the system could be without the containment chambers shown in FIGS. 8-13, although this would make it more difficult to control the composition of the atmosphere in the space between the rolling stands. In this case, the rows of transverse nozzles shown in FIGS. 10-13 would be mounted on simple rotating supports which do not form containment chambers.

The invention claimed is:

1. A plant for the continuous production of hot-rolled steel strips with a minimum thickness of 0.3 mm including in sequence, along the direction of movement of the material being processed:

a device for continuous casting of thin or medium slabs with a thickness between 40 and 150 mm and a maximum width of at least 2100 mm, a roughing mill comprising three to five stands, a first induction furnace, a water descaler, a second induction furnace, a finishing mill comprising five to seven stands, a cooling station, a cutting station, and a winding station with a pair or more of carousel coilers or single coilers, and a system to feed a protective atmosphere containing ≤3% vol. oxygen from the inlet of said second induction furnace to at least the third stand of said finishing mill, said plant further comprising, between said continuous casting device and said roughing mill, an initial section of thermal conditioning and descaling comprising in sequence an induction edge heater, an induction heater for the rest of the slab surface and a first water descaler.

2. The plant according to claim 1, wherein said first water descaler comprises a pinch roll, on the side towards the induction heater, followed by an actual descaler which is provided at the inlet with a pair of transversely movable shutters which abut directly on the edges of the slab.

3. The plant according to claim 1, wherein said initial section of thermal conditioning and descaling has a length of 3-5 meters.

4. The plant according to claim 1, wherein the edge heater is designed to operate with transverse flux using side coils with a "channel" configuration with flux concentrators.

5. The plant according to claim 1, wherein the edge heater is sized to heat a side band of the slab up to 150 mm from each edge and/or to obtain a temperature increase in said side band up to 120° C.

6. The plant according to claim 1, wherein the edge heater is equipped with a handling system that performs a transverse movement to adapt the edge heater to the slab width, to set the width of the side band to be heated and to move away and, if necessary, lift by rotation the induction coils from the edges of the slab.

7. The plant according to claim 1, wherein the first descaler includes:

a row of upper water nozzles and a row of lower water nozzles arranged transversely to the slab and with the nozzles inclined to deliver a jet in the opposite direction to the direction of movement of the slab, an upper scroll and a lower scroll specularly arranged upstream of said rows of nozzles and with their openings facing them, each of said scrolls being provided with end drains for the removal of the water collected through a lip in contact with the slab, a row of upper air nozzles and a row of lower air nozzles arranged transversely to the slab upstream of the scrolls and with the nozzles inclined to deliver a jet in the direction of movement of the slab.

8. The plant according to claim 1, wherein the second water descaler placed between the two induction furnaces comprises a first pinch roll, on the side towards the first induction furnace, an actual descaler and a second pinch roll on the side towards the second induction furnace.

9. The plant according to claim 8, wherein the second water descaler comprises:

a first row and a second row of upper water nozzles and a first row and a second row of lower water nozzles, all said rows being arranged transversely to the transfer bar and with the nozzles inclined to deliver a jet in the opposite direction to the direction of movement of the bar, each of the two rows of upper water nozzles being preceded by an upper scroll and a movable lip which in a working position comes into contact with the upper surface of the transfer bar and is aligned with the respective scroll, a first row and a second row of upper air nozzles arranged transversely to the transfer bar and with the nozzles preferably perpendicular to the upper surface of the bar, said first row being placed upstream of said first movable lip and said second row being placed downstream of the second row of upper water nozzles.

10. The plant according to claim 1, wherein the system to feed the protective atmosphere to the finishing mill includes on each side of the strip, in the space between two finishing stands, a pair of feed pipes mounted on the structure of a looper, respectively on the side upstream and downstream thereof, and from each of these feed pipes branch out two substantially horizontal rows of nozzles arranged longitudinally above and below the strip and parallel to its edges.

11. The plant according to claim 10, wherein the system to feed the protective atmosphere further comprises at least two parallel horizontal rows of nozzles arranged transversely above and below the strip at each of said longitudinal rows, the protective atmosphere reaching each pair of transverse rows through a respective feed pipe.

12. The plant according to claim 1, wherein the system to feed the protective atmosphere to the finishing mill includes, in the space between two finishing stands, at least two pairs of parallel horizontal rows of nozzles arranged transversely above and below the strip both upstream and downstream of a looper, the protective atmosphere reaching each of said pairs of transverse rows through a respective pair of feed pipes.

13. The plant according to claim 10, wherein the rows of nozzles are enclosed within a chamber formed by a pair of upper flaps and a pair of lower flaps which are shaped to allow the strip to pass through said chamber and are rotatable around an end pin to allow the chamber to open.

14. The plant according to claim 11, wherein the rows of nozzles are enclosed within a chamber formed by a pair of upper flaps and a pair of lower flaps which are shaped to allow the strip to pass through said chamber and are rotatable around an end pin to allow the chamber to open, and the transverse rows of nozzles are mounted on the flaps.

15. The plant according to claim 1, wherein the first stand of the roughing mill is a stand designed for a slab thickness reduction ≤20%.

16. The plant according to claim 1, further comprising, after the roughing mill, an emergency system for the production and removal of rough sheets which includes in sequence a pendulum shear, a stacker for the extraction of metal sheets, a rotary shear and a loop-maker.

17. The plant according to claim 1, further comprising, between the first induction furnace and the second water descaler, a mechanical scale-breaking device formed by three rollers arranged alternately above and below the transfer bar feed line and at a height such as to cause a plastic stretching of its surface which causes a breakage of the rigid scale layer.

18. The plant according to claim 1, further comprising in sequence, between the finishing rolling mill and the cooling station, a further cooling station, a further cutting station and a further winding station.

19. The plant according to claim 18, further comprising, between each cooling station and each cutting station, a mechanical descaler using counter-rotating brushes or abrasive slurry jets.

20. The plant according to claim 1, further comprising a line for anti-corrosion coating directly located after the final winding station so that it is possible to apply said coating to the strip without having to wind it in a coil first.

21. The plant according to claim 1, further comprising a system for controlling and managing the temperature of the material being processed, operatively connected to an electromagnetic brake inserted in an ingot mould forming part of the continuous casting device, as well as connected to thermocouples inserted in the copper plates of said mould and to thermal scanners arranged along the plant, said control system being operatively connected also to all the other components of the plant that actively affect the temperature of the material being processed, both in heating and in cooling.

22. The plant according to claim 2, wherein each of the shutters is mounted on a parallelogram support formed by a pair of parallel arms pivoted between the shutter and the structure of the descaler and moved by an actuator.

23. The plant according to claim 4, wherein each of the side coils is equipped with its own frequency converter so that the edge heater is able to heat in a different way the right and left edges of the slab.

24. The plant according to claim 6, wherein the handling system is implemented by placing each induction coil on a slide mobile along a transverse guide under the action of an actuator.

25. The plant according to claim 7, wherein the rows of water nozzles are arranged in opposite positions, with the nozzles aligned vertically and at the same angle of inclination.

26. The plant according to claim 9, wherein the rows of water nozzles are arranged in opposite positions, with the nozzles aligned vertically and at the same angle of inclination.

27. The plant according to claim 10, wherein each of the two rows of upper nozzles extends towards both the two stands almost to the vertical plane transverse to the strip and passing through the center of said looper, whereas each of the two rows of lower nozzles extends only towards the adjacent stand.

28. The plant according to claim 21, wherein thermal scanners are arranged at the outlet of the continuous casting device, of the roughing mill, of the first induction furnace, of the second water descaler, of the second induction furnace, of the finishing mill and of the cooling station.

29. A process for the continuous production of hot-rolled steel strips with a minimum thickness of 0.3 mm by means of a plant according to claim 1, including the following sequence of steps:

(a) continuous casting of thin or medium slabs with a thickness of 40-150 mm;
(b) roughing rolling to obtain a transfer bar in 3-5 passes;
(c) first induction heating of the transfer bar;
(d) water descaling;
(e) second induction heating of the transfer bar;
(f) finishing rolling to obtain the strip in 5-7 passes;
(g) controlled cooling of the strip; and
(h) cutting of the strip and its winding in a coil, where at least steps (e) and (f), at least until the third pass, are performed in a protective atmosphere that is slightly oxidizing, inert or slightly reducing, wherein between steps (a) and (b) there are provided further steps of:

(a') induction heating of the edges of the slab;
(a") induction heating of the rest of the slab surface; and
(a"") water descaling.

30. The process according to claim 29, wherein step (h) is replaced by the direct passage of the strip to a step of application of a protective coating with subsequent final winding.

31. The process according to claim 29, wherein in step (b) the first pass of the roughing rolling results in a reduction of the slab thickness ≤20%.

32. The process according to claim 29, wherein between steps (c) and (d) there is provided a further step (c') of mechanical breakage of the scale.

33. The process according to claim 29, wherein between steps (g) and (h) there is provided a further step (g') of mechanical descaling.

34. The process according to claim 29, wherein between steps (b) and (c) there is provided a further step of production and removal of rough sheets in the event of problems in the portion of the plant downstream of the roughing rolling.

35. The process according to claim 29, wherein step (a"") is performed with a water pressure of less than 150 bar and/or step (d) is performed with a water pressure of up to 380 bar.

36. The process according to claim 29, wherein step (e) is performed with a final temperature such as to ensure that step (f) is performed completely in the austenitic field.

37. The process according to claim 29, wherein step (a') is performed on a band up to 150 mm from each edge of the slab and/or results in a temperature increase in that band up to 120° C.

38. The process according to claim 29, wherein step (h) is followed by a step (i) of liquid cooling of the coil in a tank containing water or a slightly oxidizing aqueous solution.

39. The process according to claim 29, wherein also steps (g) and (h), in the winding part, are performed in a protective atmosphere that is slightly oxidizing, inert or slightly reducing.

* * * * *